US010246291B2

(12) United States Patent
Feng

(10) Patent No.: US 10,246,291 B2
(45) Date of Patent: Apr. 2, 2019

(54) YARN FEEDER

(71) Applicant: Shen-Te Feng, Changhua (TW)

(72) Inventor: Shen-Te Feng, Changhua (TW)

(73) Assignee: Sunshine Kinetics Technology Co. Ltd., Taichung (TW)

( * ) Notice: Subject to any disclaimer, the term of this patent is extended or adjusted under 35 U.S.C. 154(b) by 51 days.

(21) Appl. No.: 15/664,964

(22) Filed: Jul. 31, 2017

(65) Prior Publication Data

US 2019/0031464 A1 Jan. 31, 2019

(51) Int. Cl.

| | |
|---|---|
| ***B65H 49/26*** | (2006.01) |
| ***B65H 49/34*** | (2006.01) |
| ***B65H 59/38*** | (2006.01) |

(52) U.S. Cl.

CPC ..... *B65H 59/387* (2013.01); *B65H 49/26* (2013.01); *B65H 49/34* (2013.01); *B65H 2701/31* (2013.01)

(58) Field of Classification Search

CPC ..... B65H 59/387; B65H 49/26; B65H 49/34; B65H 51/06; B65H 2701/31

See application file for complete search history.

(56) References Cited

U.S. PATENT DOCUMENTS

| | | | | |
|---|---|---|---|---|
| 2,673,576 A * | 3/1954 | Dewas | B65H 49/26 | 139/452 |
| 4,530,471 A * | 7/1985 | Inoue | B23H 7/10 | 219/69.12 |
| 9,278,493 B2 * | 3/2016 | Aumueller | B29C 43/28 | |
| 2016/0122153 A1 * | 5/2016 | Bewley, Jr. | B65H 59/382 | 242/421.7 |

FOREIGN PATENT DOCUMENTS

DE 4111732 A1 * 10/1992 ..... B65H 49/18

* cited by examiner

*Primary Examiner* — William E Dondero

(74) *Attorney, Agent, or Firm* — Che-Yang Chen; Law offices of Scott Warmuth

(57) ABSTRACT

A yarn feeder may comprise a driver and a winding wheel. The driver has a front cover, a rear cover, a stator disc and a rotor disc, and the front cover and the rear cover are configured to fit together to form a housing therebetween which accommodates the stator disc and the rotor disc therein. The stator disc has a first through hole, and a plurality of teeth are formed around the first through hole to enable a couple of coils to be wound thereon. The rotor disc has a connecting hole, and a plurality of magnetic members are formed around the connecting hole. A connecting base extended from a first end of the winding wheel is engaged with the connecting hole, and the driver is connected to a tension controller to detect the tension of yarn and further to control the rotational speed of the driver.

5 Claims, 5 Drawing Sheets

YARN FEEDER

FIELD OF THE INVENTION

The present invention relates to a yarn feeder, and more particularly to a yarn feeder having a winding wheel that can be driven by a driving motor.

BACKGROUND OF THE INVENTION

Generally, a conventional yarn feeder has a winding wheel secured on a shaft, and an end of the shaft is pivotally connected to a frame while a body portion thereof is connected to a rim. Moreover, the rim is connected to a driving motor through a belt member such that the driving motor can drive the winding wheel to achieve the yarn winding.

However, the conventional yarn feeder is disadvantageous because: the driving motor can only indirectly drive the winding wheel through the belt member, and, for a period of time, the belt member is prone to be worn and have idling of transmission, which leads the imprecise in rotational speed control of the yarn feeder and in controlling the intension of yarn. Also, the components of the conventional yarn feeder such as the driving motor, the belt member and the winding wheel are bulky, which makes the yarn feeder to be space-consuming and difficulty to manufacture. Therefore, there remains a need for a new and improved design for a yarn feeder to overcome the problems presented above.

SUMMARY OF THE INVENTION

The present invention provides a yarn feeder which comprises a driver and a winding wheel. The driver has a front cover, a rear cover, a stator disc and a rotor disc, and the front cover and the rear cover are configured to fit together to form a housing therebetween. Moreover, a first axial hole and a second axial hole respectively penetrate through two central portions of the front cover and the rear cover, and the stator disc and the rotor disc are installed inside the housing. Furthermore, the stator disc having a first through hole at a central portion thereof is secured on the front cover, and a plurality of teeth are formed around the first through hole to enable a couple of coils to be wound thereon. The rotor disc has a connecting hole formed at a central portion thereof, and a plurality of magnetic members are formed around the connecting hole. The winding wheel has two second through holes respectively and axially penetrating through two ends thereof. A shaft is configured to sequentially penetrate through the two second through holes of the winding wheel, the second axial hole, the connecting hole, the first through hole and the first axial hole to lock the driver at a first end of the winding wheel. A connecting base extended from the first end of the winding wheel is engaged with the connecting hole of the rotor disc.

In one embodiment, at least an engaging block is secured on an inner periphery of the connecting hole, and the connecting base has at least a locating groove formed thereon which is configured to engage with the engaging block, thereby engaging the winding wheel with the rotor disc.

In another embodiment, a plurality of arc-shaped elastic strips are arranged around the winding wheel, and each of the elastic strips has two ends respectively connected to two ends of the winding wheel.

In still another embodiment, the driver is connected to a tension controller which is configured to detect the tension of yarn and further to control the rotational speed of the driver.

In a further embodiment, the tension controller has two fixed rods, and each of the two fixed rods is pivotally connected to a grooved wheel; the tension controller further comprises a telescopic operating rod formed between the two fixed rods, and a tension pulley is pivotally connected to the operating rod such that when the yarn is simultaneously coupled on the grooved wheels and the tension pulley, the operating rod can measure the tension and torsion of the yarn.

Comparing with conventional yarn feeder, the present invention is advantageous because: (i) the energized coils of the stator disc are configured to create a magnetic field which can drive the rotor disc to rotate, and the rotor disc is connected to the connecting base of the winding wheel such that driver can directly drive the winding wheel to rotate, which simplifies the structure of the yarn feeder and improves the driving efficiency; and (ii) the driver is connected to the tension controller which can adjust the rotational speed of the driver according to the amount of the yarn on a yarn roll, thereby achieving the effect of constant tension.

DETAILED DESCRIPTION OF THE INVENTION

The detailed description set forth below is intended as a description of the presently exemplary device provided in accordance with aspects of the present invention and is not intended to represent the only forms in which the present invention may be prepared or utilized. It is to be understood, rather, that the same or equivalent functions and components may be accomplished by different embodiments that are also intended to be encompassed within the spirit and scope of the invention.

Unless defined otherwise, all technical and scientific terms used herein have the same meaning as commonly understood to one of ordinary skill in the art to which this invention belongs. Although any methods, devices and materials similar or equivalent to those described can be used in the practice or testing of the invention, the exemplary methods, devices and materials are now described.

All publications mentioned are incorporated by reference for the purpose of describing and disclosing, for example, the designs and methodologies that are described in the publications that might be used in connection with the presently described invention. The publications listed or discussed above, below and throughout the text are provided solely for their disclosure prior to the filing date of the present application. Nothing herein is to be construed as an admission that the inventors are not entitled to antedate such disclosure by virtue of prior invention.

Figure 1:
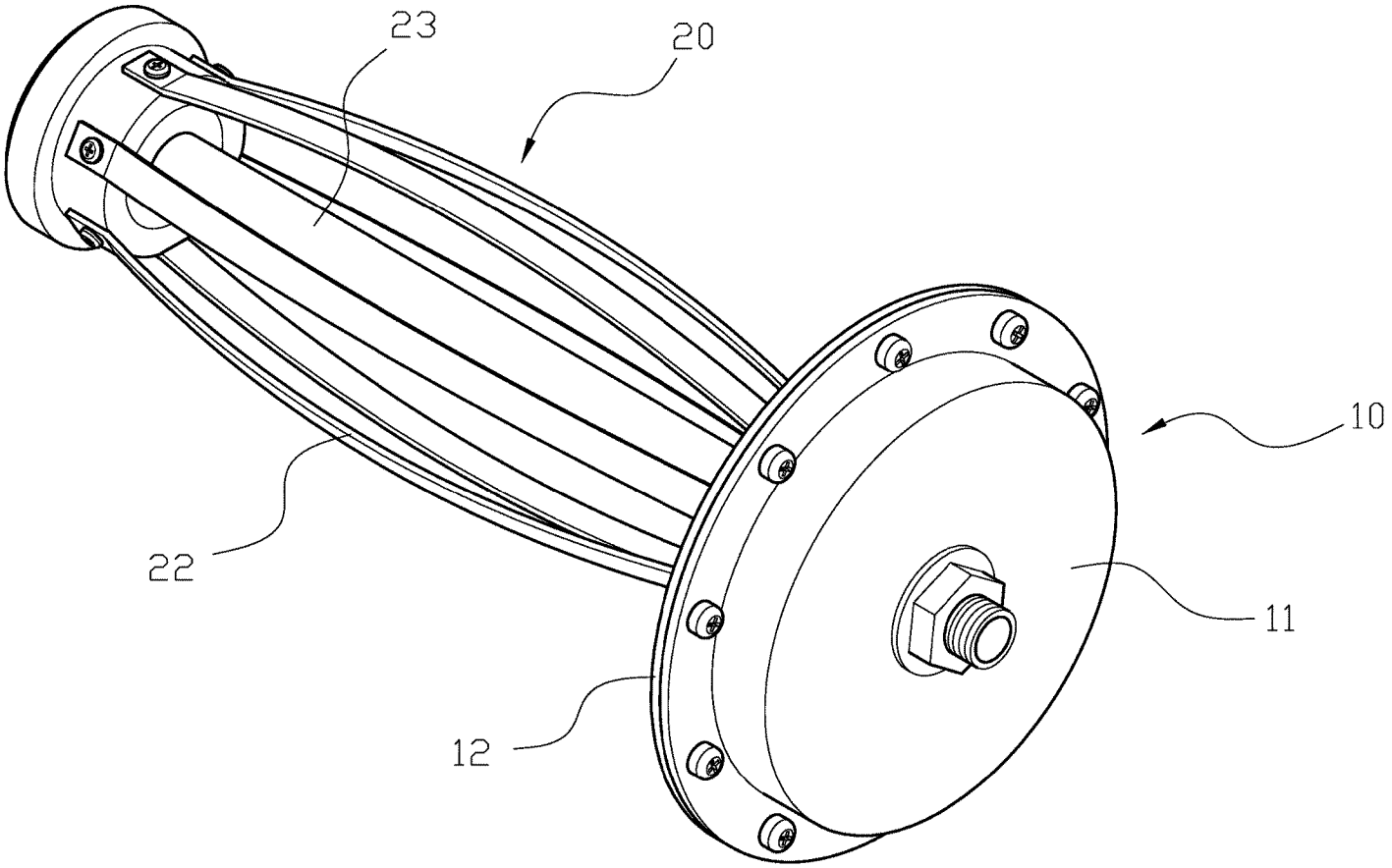
FIG. 1 is a three-dimensional assembly view of a yarn feeder in the present invention.
Figure 2:
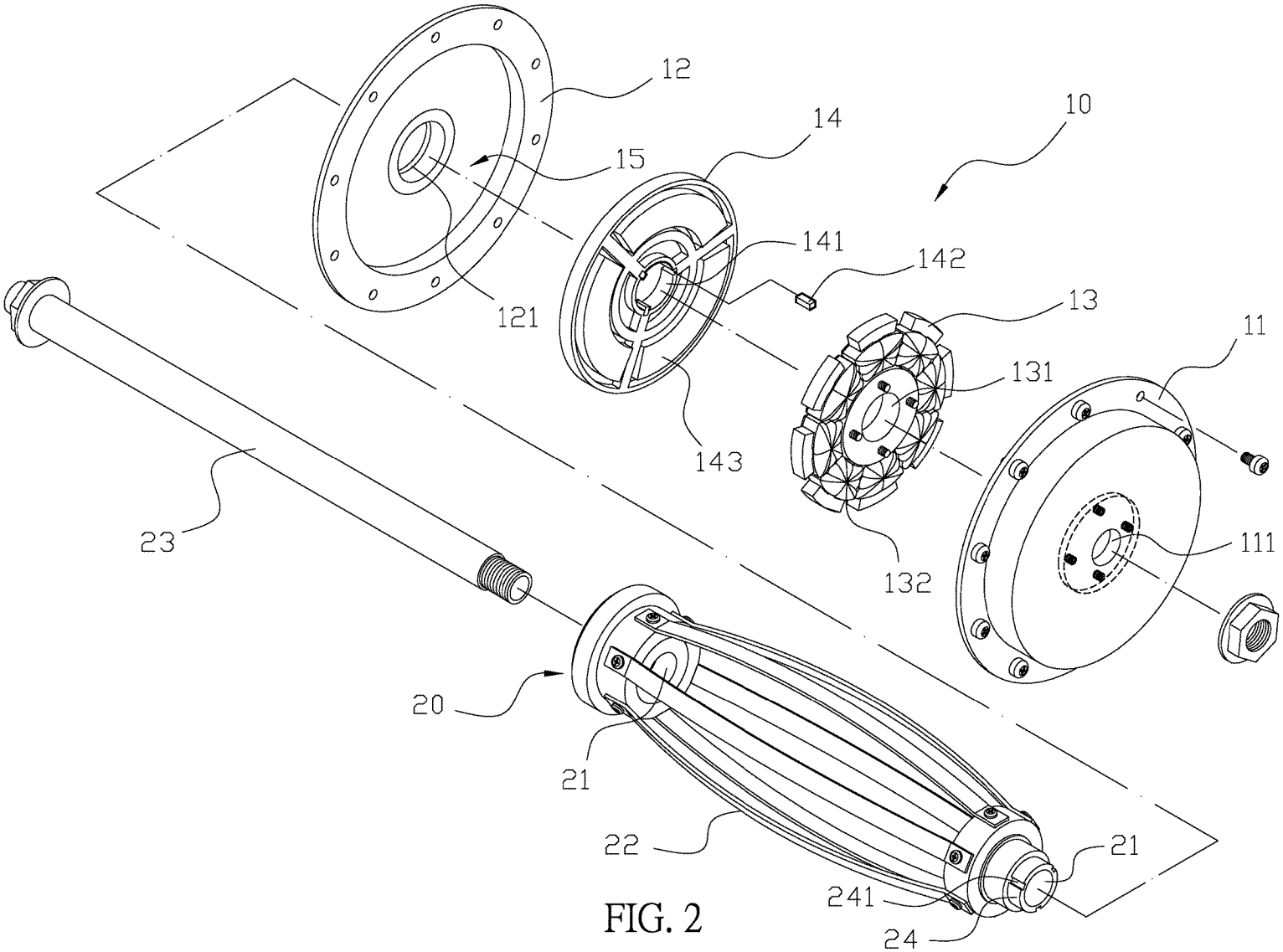
FIG. 2 is a three-dimensional exploded view of the yarn feeder in the present invention.
Figure 3:
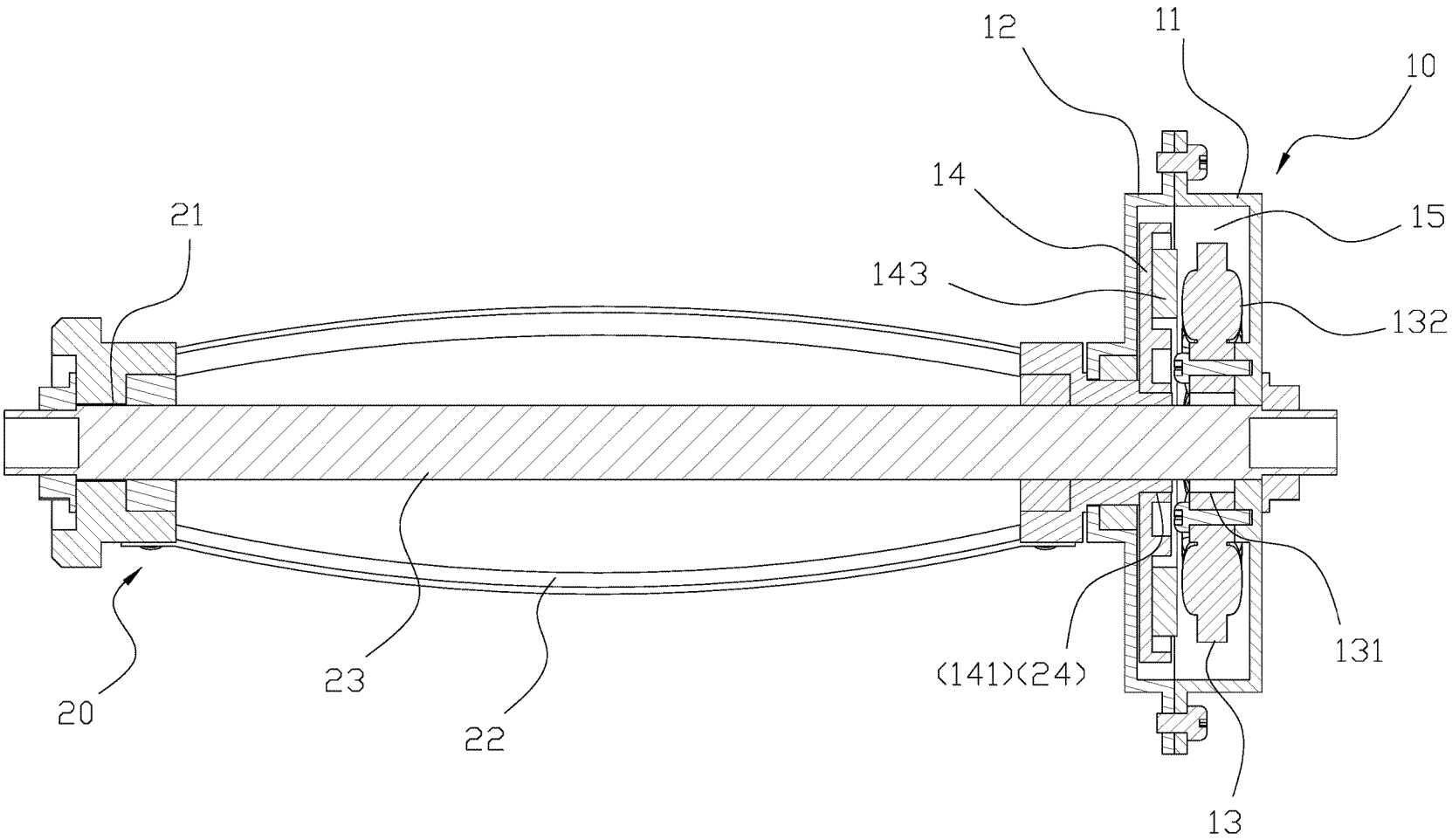
FIG. 3 is a sectional assembly view of the yarn feeder in the present invention.
Figure 4:
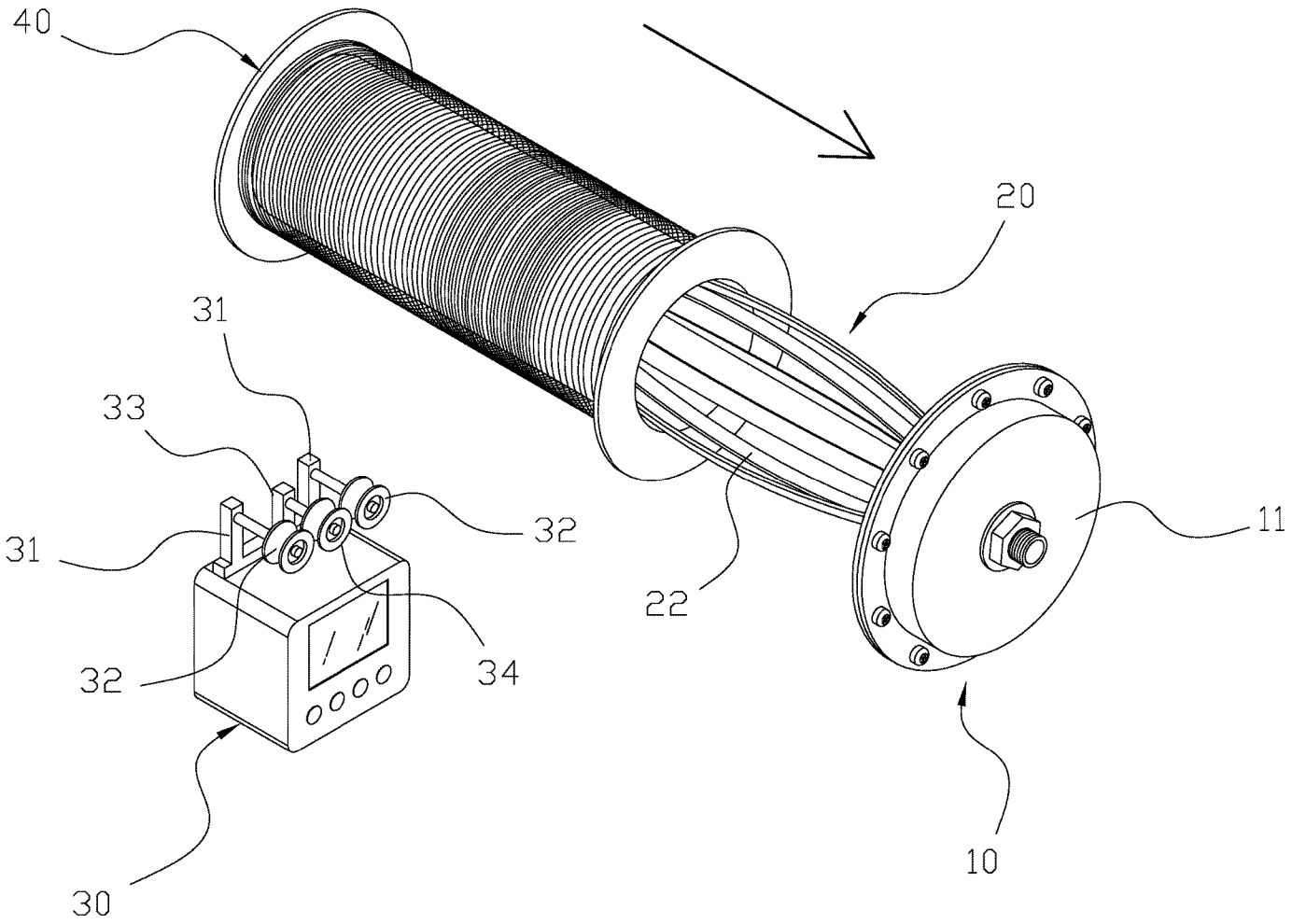
FIG. 4 is a schematic view of the yarn feeder of the present invention when in use.
Figure 5:
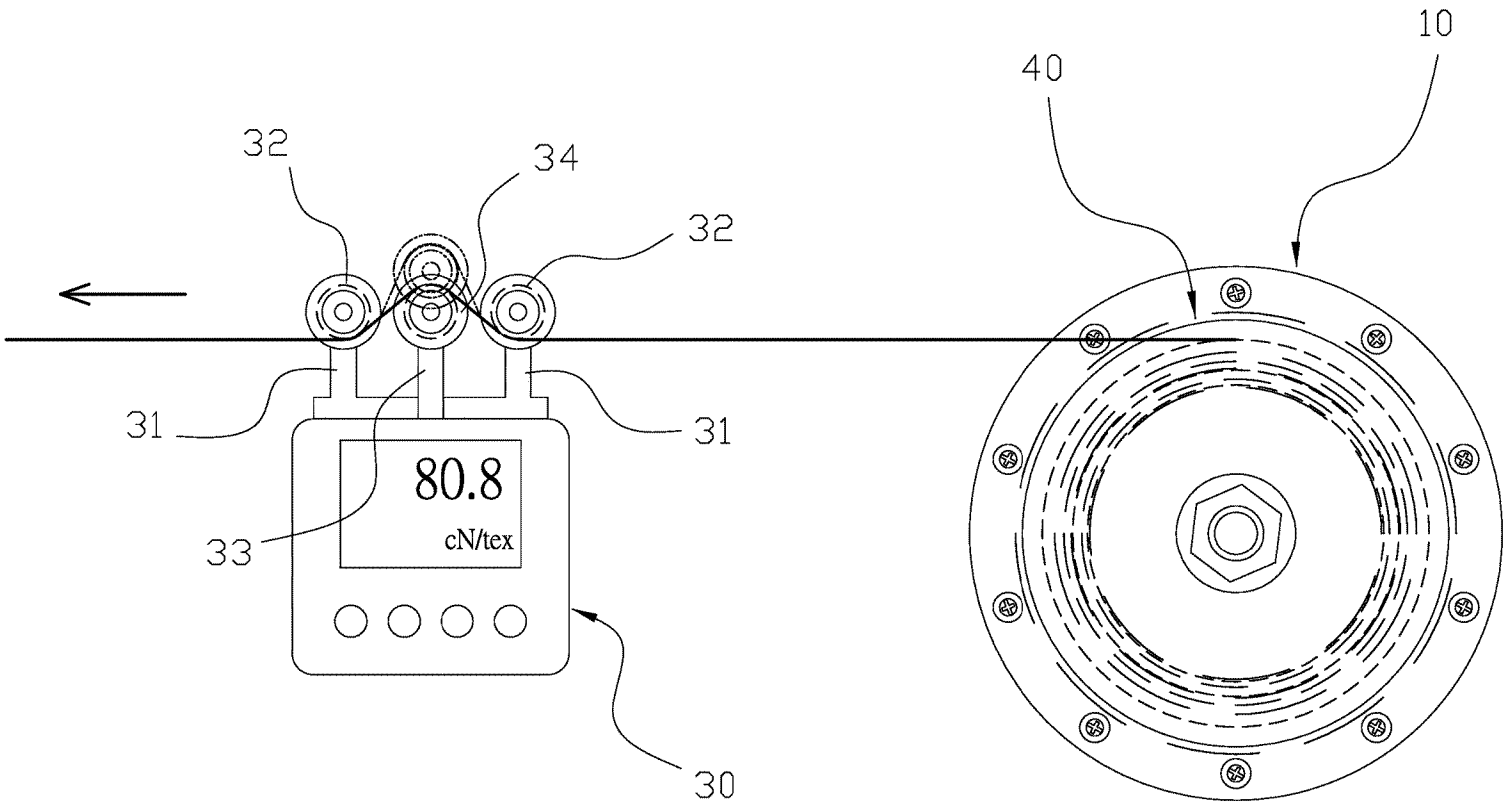
FIG. 5 is another schematic view of the yarn feeder of the present invention when in use.

In order to further understand the goal, characteristics and effect of the present invention, a number of embodiments along with the drawings are illustrated as following:

Referring to FIGS. 1 to 5, the present invention provides a yarn feeder which comprises a driver (10), a winding wheel (20) and a tension controller (30). The driver (10) has a front cover (11), a rear cover (12), a stator disc (13) and a rotor disc (14), and the front cover (11) and the rear cover (12) are configured to fit together to form a housing (15) therebetween. Moreover, a first axial hole (111) and a second axial hole (121) respectively penetrate through two central portions of the front cover (11) and the rear cover (12), and the stator disc (13) and the rotor disc (14) are installed inside the housing (15). Furthermore, the stator disc (13) having a first through hole (131) at a central portion thereof is secured on the front cover (11), and a plurality of teeth are formed around the first through hole (131) to enable a couple of coils (132) to be wound thereon. The rotor disc (14) has a connecting hole (141) formed at a central portion thereof, and at least an engaging block (142) is secured on an inner periphery of the connecting hole (141). In addition, the rotor disc (14) comprises a plurality of magnetic members (143) formed around the connecting hole (141). The winding wheel (20) has two second through holes (21) respectively and axially penetrating through two ends thereof, and a plurality of arc-shaped elastic strips (22) are arranged around the winding wheel (20), and each of the elastic strips (22) has two ends respectively connected to two ends of the winding wheel (20). A shaft (23) is configured to sequentially penetrate through the two second through holes (21) of the winding wheel (20), the second axial hole (121), the connecting hole (141), the first through hole (131) and the first axial hole (111) to lock the driver (10) at a first end of the winding wheel (20). A connecting base (24) extended from the first end of the winding wheel (20) is engaged with the connecting hole (141) of the rotor disc (14). Furthermore, the connecting base (24) has at least a locating groove (241) formed thereon which is configured to engage with the engaging block (142) on the inner periphery of the connecting hole (141), thereby engaging the winding wheel (20) with the rotor disc (14). When the coils (132) of the stator disc (13) are energized by electric current, a magnetic field is created to drive the rotor disc (14) and the winding wheel (20) to rotate synchronously. Also, the driver (10) is connected to the tension controller (30) which is configured to detect the tension of yarn and further to control the rotational speed of the driver (10). Additionally, the tension controller (30) has two fixed rods (31), and each of the two fixed rods (31) is pivotally connected to a grooved wheel (32). Moreover, the tension controller (30) further comprises a telescopic operating rod (33) formed between the two fixed rods (31), and a tension pulley (34) is pivotally connected to the operating rod (33). Thus, when the yarn is simultaneously coupled on the grooved wheels (32) and the tension pulley (34), the operating rod (33) can measure the tension and torsion of the yarn.

In actual application, referring to FIGS. 1 to 5, the shaft (23) is configured to penetrate through two second through holes (21) of the winding wheel (20), the second axial hole (121) of the rear cover (12), the connecting hole (141) of the rotor disc (14), the first through hole (131) of the stator disc (13) and the first axial hole (111) of the front cover (11) to engage with a nut. Thus, the rotor disc (14) and the stator disc (13) are accommodated in the housing (15) between the front cover (11) and the rear cover (12) and the connecting base (24) of the winding wheel (20) is engaged with the engaging block (142) on the inner periphery of the connecting hole (141) to complete the connection between the driver (10) and the winding wheel (20). When the yarn feeder of the present invention is in use, a yarn roll (40) is disposed on the winding wheel (20), and the elastic strips (22) are configured to abut against an inner periphery of the yarn roll (40) such that the winding wheel (20) can firmly drive the yarn roll (40) to have synchronous rotation. The yarn on the yarn roll (40) is adapted to sequentially couple with a lower portion of the first grooved wheel (32), an upper portion of the tension pulley (34) and a lower portion of another grooved wheel (32) to pass through the tension controller (30) such that the tension pulley (34) can measure the tension and torsion of the yarn through pushing the coupled yarn upwardly. Meanwhile, the energized coils (132) of the stator disc (13) are configured to create a magnetic field which drives the rotor disc (14) to rotate. Furthermore, the rotor disc (14) is connected to the connecting base (24) of the winding wheel (20) such that the driver (10) can directly drive the winding wheel (20) to rotate, which simplifies the structure of the yarn feeder and improves the driving efficiency. Also, the present invention has the tension controller (30) which can adjust the rotational speed of the driver (10) according to the amount of the yarn on the yarn roll (40), thereby achieving the effect of constant tension.

Having described the invention by the description and illustrations above, it should be understood that these are exemplary of the invention and are not to be considered as limiting. Accordingly, the invention is not to be considered as limited by the foregoing description, but includes any equivalents.

What is claimed is:

1. A yarn feeder comprising:

a driver having a front cover, a rear cover, a stator disc and a rotor disc, and the front cover and the rear cover configured to fit together to form a housing therebetween; a first axial hole and a second axial hole respectively penetrating through two central portions of the front cover and the rear cover, and the stator disc and the rotor disc installed inside the housing; the stator disc, which has a first through hole at a central portion thereof, secured on the front cover, and a plurality of teeth formed around the first through hole to enable a couple of coils to be wound thereon; the rotor disc having a connecting hole formed at a central portion thereof, and a plurality of magnetic members formed around the connecting hole; and a winding wheel having two second through holes respectively and axially penetrating through two ends thereof; a shaft configured to sequentially penetrate through the two second through holes of the winding wheel, the second axial hole, the connecting hole, the first through hole and the first axial hole to lock the driver at a first end of the winding wheel; a connecting base, which is extended from the first end of the winding wheel, engaged with the connecting hole of the rotor disc such that when the coils of the stator disc energized by electric current, a magnetic field created to drive the rotor disc and the winding wheel to rotate synchronously.

2. The yarn feeder of claim 1, wherein at least an engaging block is secured on an inner periphery of the connecting hole, and the connecting base has at least a locating groove formed thereon which is configured to engage with the engaging block, thereby engaging the winding wheel with the rotor disc.

3. The yarn feeder of claim 1, wherein a plurality of arc-shaped elastic strips are arranged around the winding wheel, and each of the elastic strips has two ends respectively connected to two ends of the winding wheel.

4. The yarn feeder of claim 1, wherein the driver is connected to a tension controller which is configured to detect the tension of yarn and further to control the rotational speed of the driver.

5. The yarn feeder of claim 4, wherein the tension controller has two fixed rods, and each of the two fixed rods is pivotally connected to a grooved wheel; the tension controller further comprises a telescopic operating rod formed between the two fixed rods, and a tension pulley is pivotally connected to the operating rod such that when the yarn is simultaneously coupled on the grooved wheels and the tension pulley, the operating rod is configured to measure the tension and torsion of the yarn.

* * * * *